US010619959B1

(12) United States Patent
Loveday, IV et al.

(10) Patent No.: US 10,619,959 B1
(45) Date of Patent: Apr. 14, 2020

(54) RIBLESS DOUBLE STACK AMMUNITION MAGAZINE

(71) Applicant: Elite Tactical Systems Group, LLC, Cheyenne, WY (US)

(72) Inventors: George E. Loveday, IV, Lenoir City, TN (US); George E. Loveday, III, Knoxville, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

(21) Appl. No.: 15/810,115

(22) Filed: Nov. 12, 2017

(51) Int. Cl.

| | |
|---|---|
| ***F41A 9/69*** | (2006.01) |
| ***F41A 9/65*** | (2006.01) |
| ***F41A 9/70*** | (2006.01) |
| ***F41A 9/72*** | (2006.01) |

(52) U.S. Cl.
CPC *F41A 9/65* (2013.01); *F41A 9/69* (2013.01); *F41A 9/70* (2013.01); *F41A 9/72* (2013.01)

(58) Field of Classification Search
CPC ..... F41A 9/65; F41A 9/69; F41A 9/70; F41A 9/72
USPC ..... 42/7, 50
See application file for complete search history.

(56) References Cited

U.S. PATENT DOCUMENTS

| | | | | | |
|---|---|---|---|---|---|
| 3,226,869 | A * | 1/1966 | Musgrave | F41A 9/69 | 42/50 |
| 3,345,771 | A * | 10/1967 | Silsby | F41A 9/69 | 42/18 |
| 4,580,364 | A * | 4/1986 | Vyprachticky | F41A 9/65 | 42/50 |
| 4,862,618 | A * | 9/1989 | Szabo | F41A 9/69 | 42/7 |
| 5,495,687 | A * | 3/1996 | Waiser | F41A 9/70 | 42/50 |
| 8,966,801 | B1 * | 3/2015 | Bentley | F41A 9/71 | 42/49.01 |
| 8,991,086 | B2 * | 3/2015 | Fitzpatrick | F41A 9/69 | 42/50 |
| 2007/0107291 | A1 * | 5/2007 | Tal | F41A 9/83 | 42/87 |
| 2014/0075810 | A1 * | 3/2014 | Mikroulis | F41A 17/36 | 42/50 |
| 2016/0025437 | A1 * | 1/2016 | Slocum | F41A 9/83 | 42/87 |

* cited by examiner

*Primary Examiner* — Stephen Johnson
(74) *Attorney, Agent, or Firm* — J. Kenneth Hoffmeister

(57) ABSTRACT

A ribless double stack magazine for use with a firearm. The inner walls of an embodiment of the magazine body define a trapezoidal cross section and there are no ribs extending inwardly from any of the inner walls. The magazine body is fabricated from a plastic material that minimizes friction and bulge slightly in response to pressure on cartridges from the spring. The thickness of the sidewalls is sufficient to control the bulge and maintain the exterior dimensions of the magazine within the tolerances necessary to properly function in the magazine well of a firearm.

16 Claims, 4 Drawing Sheets

RIBLESS DOUBLE STACK AMMUNITION MAGAZINE

BACKGROUND

Conventional modern firearm components and magazines, such as double stack magazines, are generally fabricated from metals, such as steel or aluminum, or from thermoplastic polymer composites, such as polypropylene (PP) or nylon, reinforced with other materials to meet specific performance requirements not obtainable from the thermoplastic polymers alone.

Double stack magazines hold and feed two columns of ammunition into a firearm. At the top of a double stack magazine, the dimensions narrow to merge the two columns of ammunition into a single column so as to present a single round of ammunition ready for chambering into the firearm at the feed lips. The merging of the two columns substantially increases the amount of force that must be exerted by the spring against the follower to prevent binding. There is a significant amount of friction between the metal of the casing of the ammunition and the sidewall. In order to reduce this friction and stiffen the side walls to handle the stresses, the sidewalls of conventional double stack magazines incorporate a rib that minimizes the contact area to reduce friction and provides reinforcement. It is with respect to these and other considerations that the present invention has been made.

BRIEF SUMMARY

The following summary discusses various aspects of the invention described more fully in the detailed description and claimed herein. It is not intended and should not be used to limit the claimed invention to only such aspects or to require the invention to include all such aspects.

Aspects of a ribless double stack magazine for use with a firearm are described herein. The magazine includes a tubular housing having a feed end and a floor end. The feed end terminates in a pair of feed lips. The entire magazine housing (body), including the feed lips, is fabricated from a plastic material. The upper portion of magazine proximate the feed end includes a neck tapered toward the feed lips. Internally, the magazine includes a spring engaging the floor plate at one end and a follower at the other end. The necked portion merges the two columns of cartridges and presents a single cartridge at the feed lips for feeding into the firearm.

The amount of force applied by the spring and follower that is transferred from any given cartridge to the housing depends upon the location of the cartridge within the housing. Some of the force is transferred to housing at the point where the cartridge makes contact with the housing. The housing tends to swell, or bulge out, in response to the horizontal component of the force.

The inner faces of the sidewalls of the housing do not have a protruding rib to provide structural reinforcement. Instead, the overall thickness of the sidewalls is increased to compensate for the loss in rigidity that occurs when fabricating a magazine housing from a homogeneous or unreinforced plastic material. The distance separating the inner faces of the sidewalls proximate to the rear wall is greater than the distance separating the inner faces of the sidewalls proximate to the front wall.

BRIEF DESCRIPTION OF THE DRAWINGS

Further features, aspects, and advantages of the invention represented by the embodiments described present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Aspects of a ribless double stack magazine for use with a firearm are described herein and illustrated in the accompanying figures. The inner walls of an embodiment of the magazine body define a trapezoidal cross section and there are no ribs extending inwardly from any of the inner walls. The magazine body is fabricated from a plastic material that minimizes friction and bulge slightly in response to pressure on cartridges from the spring. The thickness of the sidewalls is sufficient to control the bulge and maintain the exterior dimensions of the magazine within the tolerances necessary to properly function in the magazine well of a firearm.

Figure 1:
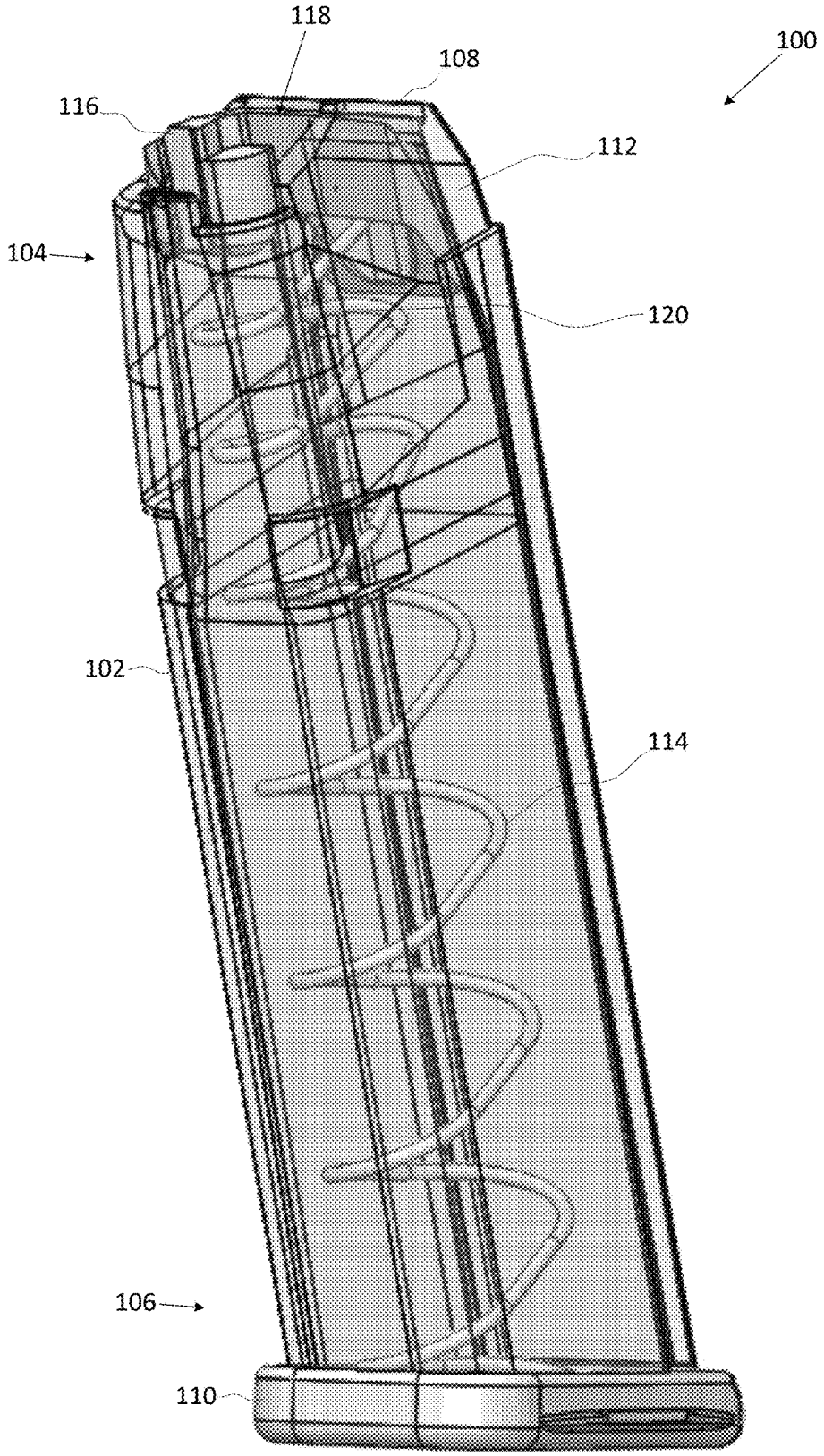
FIG. 1 is a perspective view illustrating aspects of the present invention embodied in a double stack magazine for a magazine fed firearm.

FIG. 1 is a perspective view illustrating aspects of the present invention embodied in a ribless double stack magazine for a magazine fed firearm. The magazine 100 includes a tubular housing 102 having a feed end 104 and a floor end 106. The feed end 104 terminates in a pair of feed lips 108. The entire magazine housing (body) 102, including the feed lips 108, is fabricated from a plastic material. In other words, the magazine 100 is not a hybrid of plastic and a secondary material, such as a plastic body with steel feed lips. In a preferred embodiment, the entire magazine housing 102 is fabricated from an unreinforced plastic.

The upper portion of the housing 102 proximate to the feed end 104 is configured for insertion into the magazine well of the firearm. The feed end 104 interfaces with the firearm to guide ammunition cartridges into the firing chamber. In the illustrated embodiment, the open floor end 106 is closed by a removable floor plate 110. The upper portion of magazine 100 proximate the feed end 104 includes a neck 112 tapered toward the feed lips 108.

Internally, the magazine 100 includes a spring 114 engaging the floor plate 110 at one end and a follower 116 at the other end. In use, the spring 114 pushes the follower 116 upward through the housing 102 as ammunition is fed into the firearm. The follower 116 includes a shelf 118 that directly supports the ammunition cartridges loaded into the magazine 100.

Figure 2:
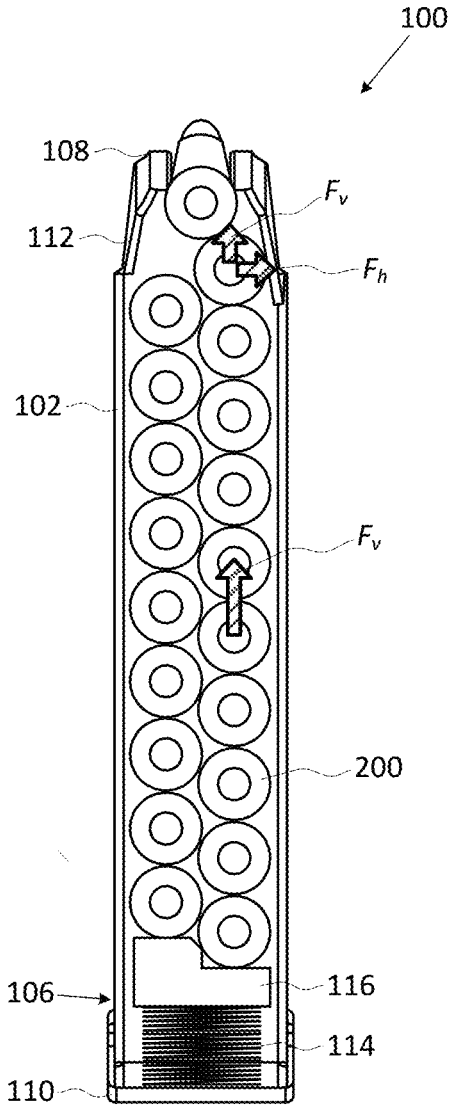
FIG. 2 is rear elevation view illustrating aspects of the magazine depicted in FIG. 1.

FIG. 2 is a rear elevation view of the double stack magazine illustrating aspects of the present invention. The magazine 100 is configured to hold cartridges 200, illustrated in phantom, used by the firearm in a double stack configuration. More specifically, the majority of the housing 102 is dimensioned to hold two columns of cartridges 200 substantially side-by-side. The necked portion 112 merges the two columns of cartridges and presents a single cartridge 200 at the feed lips 108 for feeding into the firearm.

The amount of force applied by the spring 114 and follower 116 that is transferred from any given cartridge to the housing 102 depends upon the location of the cartridge 200 within the housing. In the figures, the force components are represented by the hatched arrows. Below the neck 112, most, if not all, of the force, $F_v$, is applied in the vertical direction pushing the cartridge toward the feed end 104 of the magazine 100. As the cartridge 200 reaches the neck 112, the horizontal component of the force, $F_h$, increases as the neck 112 creates resistance to vertical movement. Some of the force is transferred to housing 102 at the point where the cartridge 200 makes contact with the housing 102. The housing 102 tends to swell, or bulge out, in response to the horizontal component of the force, $F_h$.

Figure 3:
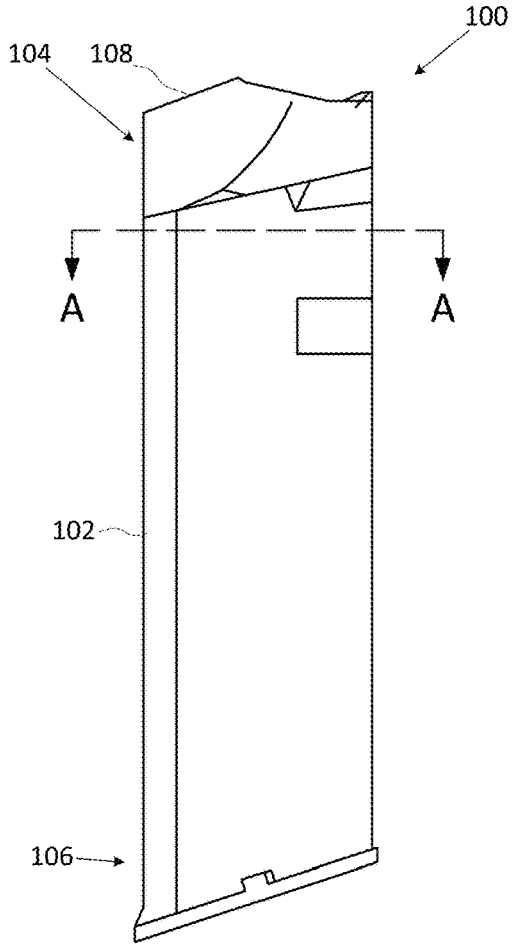
FIG. 3 is a side elevation view illustrating aspects of the magazine depicted in FIG. 1.
Figure 4:
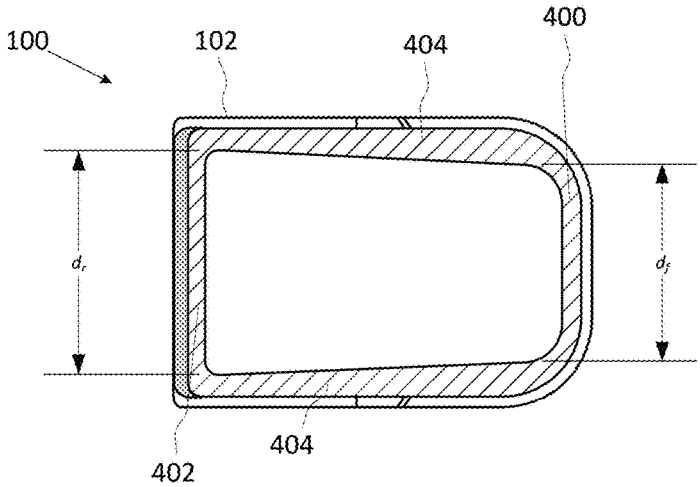
FIG. 4 is a sectional plan view taken along section A-A of FIG. 3.

FIG. 3 illustrates a side elevation view of the magazine housing. FIG. 4 illustrates a cross sectional top plan view of the magazine 100 taken along section line A-A in FIG. 1 illustrating the effect of the applied forces. The housing 102 defines a front wall 400, a rear wall 402, and two opposing sidewalls 404. Departing from conventional double stack magazine design, the inner faces of the sidewalls 404 of the housing 102 do not have a protruding rib to provide structural reinforcement. Instead, the overall thickness of the sidewalls 404 is increased to compensate for the loss in rigidity (i.e. tensile and/or flexural strength) that occurs when fabricating a magazine housing 102 from a homogeneous or unreinforced plastic material instead of a metal, a reinforced polymer (e.g., a long fiber thermoplastic polypropylene), or a metal-plastic hybrid. In other words, the inner faces of the sidewalls 404 are substantially flat.

The distance separating the inner faces of the sidewalls 404 proximate to the rear wall 402, $d_r$, is greater than the distance separating the inner faces of the sidewalls 404 proximate to the front wall 400, $d_f$. In other words, in a cross section of a preferred embodiment of the magazine 100, the inner faces of the sidewalls 404 generally define a trapezoid. Having a wider distance separating the inner faces of the sidewalls 404 allows the cartridges, especially the tail of the cartridge, to pivot into the proper position (i.e., nose up, tail down) for feeding into the firearm.

Due to the merging the two columns of cartridges, the likelihood of binding is significantly higher in a double stack magazine than in a single stack magazine. Accordingly, the force applied by the spring 114 and follower 116 is considerably greater in the double stack magazine than in a single stack magazine. The sidewalls 404 are subjected to greatest horizontal force component at or near the neck 112 of the housing 102 (i.e., proximate to section line A-A). This increased force presents a number of challenges when designing a double stack magazine from materials other than metal. One significant concern in the design and manufacture of double stack magazines is swelling, particularly when using an unreinforced plastic. The use of unreinforced plastics is desirable for use in a translucent or optically transparent magazine.

Swelling in a double stack magazine is a concern due to the tight tolerances required for proper operation of the magazine. The exterior dimensions of the magazine must be within a specified range for the magazine to properly fit within the magazine well of the firearm. If the exterior dimensions are too small, the magazine will not be properly retained and is likely to fall out of the magazine well. Conversely, if the exterior dimensions are too large, it will not be possible to insert the magazine into or extract the magazine out the magazine well. A magazine that does not freely drop from the magazine well of a firearm when the magazine release is triggered is generally considered unsuitable for use. Meanwhile, the interior dimensions are largely regulated by the cartridge dimensions and the physics of merging two columns of cartridges into a single column.

Conventional double stack magazines constructed using metal, reinforced polymers, or hybrid materials have thin, ribbed sidewalls exhibiting sufficient rigidity to withstand the forces encountered in a double stack magazine with minimal swelling. The rib found in conventional double stack magazines provides structural support and creates separation between the cartridge and the sidewall of the magazine, which minimizes friction and allows cartridges to pivot. The thin sidewalls offer greater flexibility in dealing with the dimensions restrictions on the magazine design. By way of example, the measured swelling of a representative original equipment manufacturer (OEM) hybrid double stack magazine incorporating a rib was about 0.152 mm (0.006 in).

Figure 5A:
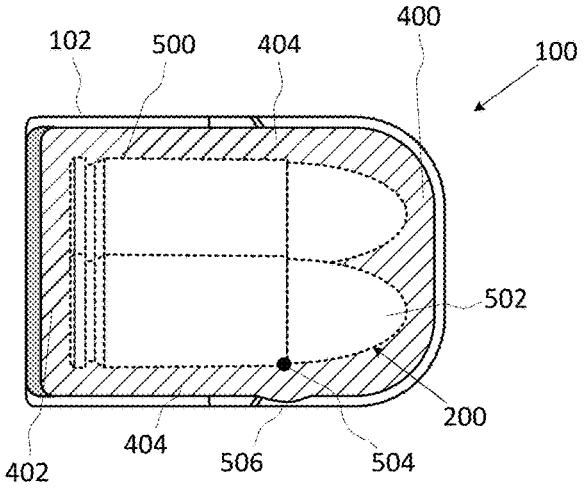
FIG. 5A illustrates the swelling of the magazine housing in a plastic magazine according to the present invention due to the applied forces at the initial contact region.
Figure 5B:
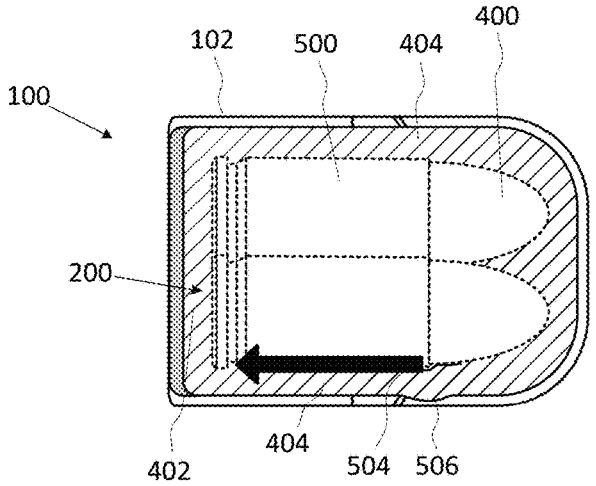
FIG. 5B illustrates the expansion of the contact region of the magazine housing in a plastic magazine according to the present invention as the magazine swells.
Figure 5C:
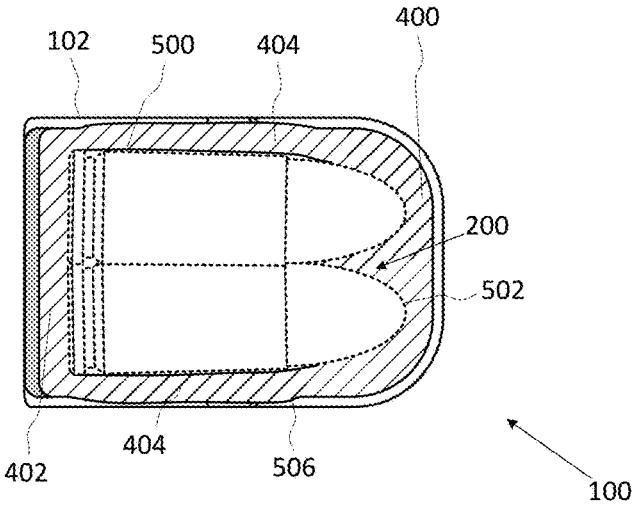
FIG. 5C illustrates the final swelling of the magazine housing in a plastic magazine according to the present invention due to the applied forces across the expanded contact region.

FIGS. 5A through 5C illustrate the effect of the applied forces on an embodiment of the magazine according to the present invention. Due to the taper of the sidewalls 404, the casing 500 of the cartridge 200 engages only the contact region 504 of the sidewall 404, rather than all, or at least a majority of the sidewall 404. The applied forces result in a swell region 506. Under the applied forces, the position of the contact region 504 is pushed outward until it aligns with the next wider point of the tapered sidewall. In the illustrated embodiment, the next wider point is located rearward of the initial contact region. In other words, the contact region 504 and the swell region 506 expands in the direction of the widening taper (in the illustrated embodiment, toward the rear wall) until the strength of housing 100 at the contact region 504 is sufficient to handle the distributed forces. In FIG. 5B, the contact region and its expansion of is depicted by the solid black arrow.

While FIGS. 5A-C depict the expansion of the swell region 506 only in the rearward direction in response to contact between the sidewalls and the casing of the cartridge, it should be appreciated the swell region may also expand in the forward direction where the bullet forcefully engages the sidewall.

The measured swelling of the double stack magazine without a rib or any taper to the sidewalls was about 0.76 mm (0.03 in), or five times the measured swelling of the OEM magazine, which was sufficient to cause insertion and extraction problems with the magazine. In contrast, the measured swelling of the double stack magazine without a rib, but having tapered sidewalls as disclosed herein, was about 0.51 mm (0.02 in), or just over 3 times the measured swelling of the OEM magazine. This reduction in swelling attributable to the inclusion of the tapered sidewalls is sufficient to allow the magazine 100 to operate without any insertion or extraction issues.

The lack of a protruding rib serving as a stand-off to hold the cartridges away from the sidewalls 404 also allows a greater amount of surface area of the cartridges and the sidewalls 404 to come into contact. This increases the friction between the cartridges and the sidewalls 404 and increases the likelihood of binding. This increase in friction is offset somewhat because many plastics have lower coefficients of friction than the metals used in conventional double stack magazines. Accordingly, selection of a plastic having a low coefficient of friction is desirable when constructing a double stack magazine as described herein.

Returning now to FIG. 1, aspects of the magazine 100 include one or more optional reliefs 120 in the inner face of the sidewalls. In manufacturing magazines according to the present invention, it is difficult to adequately cool the large amount of plastic used in the sidewalls so as to avoid deformation of the housing when the core is removed. The reliefs reduce the amount of plastic to aid cooling and have no significant effect on the interface between cartridges and the inner face of the sidewalls. Even with the reliefs, the profile of inner face of the sidewall remains substantially flat. In other words, the reliefs do not create ribs or other projections extending into the cavity of the housing. The size, shape, configuration, and number of reliefs may be varied as necessary to achieve the requisite cooling without departing from the scope and spirit of the present invention.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A double stack magazine for feeding ammunition into a magazine fed firearm, the double stack magazine comprising:

a tubular housing having a front wall, a rear wall, and two opposing sidewalls, the housing defining an open bottom end and an open top end terminating in a pair of feed lips, the housing being fabricated entirely from plastic, the tubular housing dimensioned to hold two columns of ammunition and having a narrowing neck proximate to the open top end to merge the two columns of ammunition and present a single round of ammunition centered between the feed lips for feeding into the firearm, the inner faces of the entirety of the opposing sidewalls having no protruding rib, wherein the inner faces of the tubular housing generally define a trapezoid, wherein each opposing sidewall is a continuous uninterrupted planar surface;

a floor plate releaseably connected to the tubular housing to cover the open bottom end;

a follower disposed within the tubular housing; and a spring operatively positioned within the tubular housing between the floor plate and the follower, the spring biasing the follower toward the open top end.

2. The double stack magazine of claim 1 wherein the distance between the sidewalls proximate to the rear wall is greater than the distance between the sidewalls proximate to the front wall to define a contact point at which one of the sidewalls initially makes contact with a casing of a round of ammunition, the contact point moving towards the rear wall as the contacting sidewall swells.

3. The double stack magazine of claim 1 wherein the tubular housing is fabricated from an unreinforced plastic.

4. The double stack magazine of claim 1 wherein the tubular housing is optically transparent.

5. A double stack magazine for a magazine fed firearm, the double stack magazine comprising:

a tubular housing defining a longitudinal cavity, the tubular housing having an open top end terminating in a pair of feed lips and an open bottom end, the longitudinal cavity having a generally trapezoidal cross section, each opposing sidewall of the longitudinal cavity being a continuous uninterrupted planar surface, the longitudinal cavity having a lower portion dimensioned to hold two columns of ammunition and upper portion tapering toward the open top end to present a single column of ammunition at the feed lips, the tubular housing fabricated entirely from a material other than metal;

a floor plate releaseably connected to the tubular housing to cover the open bottom end;

a follower disposed within the tubular housing; and a spring operatively positioned within the tubular housing between the floor plate and the follower, the spring biasing the follower toward the open top end.

6. The double stack magazine of claim 5 wherein tubular housing defines a front wall, a rear wall, and two sidewalls, the distance between the sidewalls proximate to the rear wall being greater than the distance between the sidewalls proximate to the front wall to define a contact point at which one of the sidewalls initially makes contact with a casing of a round of ammunition, the contact point moving towards the rear wall as the contacting sidewall swells.

7. The double stack magazine of claim 5 wherein the tubular housing has no ribs protruding into the longitudinal cavity.

8. The double stack magazine of claim 5 wherein the inner faces of the tubular housing are substantially flat.

9. The double stack magazine of claim 5 wherein the tubular housing is fabricated entirely from plastic.

10. The double stack magazine of claim 9 wherein the tubular housing is fabricated from an unreinforced plastic.

11. The double stack magazine of claim 5 wherein the tubular housing is optically transparent.

12. A double stack magazine for a magazine fed firearm, the double stack magazine comprising:

a tubular housing having a front wall, a rear wall, and two opposing sidewalls, the housing defining an open bottom end and an open top end terminating in a pair of feed lips, the housing being fabricated entirely from plastic, the tubular housing dimensioned to hold two columns of ammunition and having a narrowing neck proximate to the open top end to merge the two columns of ammunition and present a single round of ammunition engaging both feed lips for feeding into the firearm, the inner faces of the opposing sidewalls being substantially flat, continuous, uninterrupted planar surfaces, and the distance between the inner faces increasing from the front wall to the rear wall;

a floor plate releaseably connected to the tubular housing to cover the open bottom end;

a follower disposed within the tubular housing; and a spring operatively positioned within the tubular housing between the floor plate and the follower, the spring biasing the follower toward the open top end.

13. The double stack magazine of claim 12 wherein the distance between the sidewalls proximate to the rear wall being greater than the distance between the sidewalls proximate to the front wall to define a contact point at which one of the sidewalls initially makes contact with a casing of a round of ammunition, the contact point moving towards the rear wall as the contacting sidewall swells.

14. The double stack magazine of claim 12 wherein the tubular housing is fabricated from an unreinforced plastic.

15. The double stack magazine of claim 12 wherein the inner faces of the opposing sidewalls have no inwardly protruding rib.

16. The double stack magazine of claim 12 wherein the tubular housing is optically transparent.

* * * * *